US007363930B2

(12) United States Patent
Vanderminden, Sr.

(10) Patent No.: US 7,363,930 B2
(45) Date of Patent: Apr. 29, 2008

(54) UMBRELLA TILT MECHANISM

(75) Inventor: Robert D. Vanderminden, Sr., Granville, NY (US)

(73) Assignee: Telescope Casual Furniture, Inc., Granville, NY (US)

( * ) Notice: Subject to any disclaimer, the term of this patent is extended or adjusted under 35 U.S.C. 154(b) by 1305 days.

(21) Appl. No.: 09/895,950

(22) Filed: Jun. 29, 2001

(65) Prior Publication Data

US 2003/0000560 A1 Jan. 2, 2003

(51) Int. Cl.
*A45B 17/00* (2006.01)

(52) U.S. Cl. ..... 135/20.3; 135/20.1; 135/98; 248/516; 248/514; 403/93; 403/96

(58) Field of Classification Search ..... 135/15.1, 135/16, 20.1, 20.3, 98, 155; 52/165, 116; 116/174; 248/516, 514, 515; 403/93, 96
See application file for complete search history.

(56) References Cited

U.S. PATENT DOCUMENTS

| | | | | | |
|---|---|---|---|---|---|
| 987,918 | A * | 3/1911 | Schmid et al. | 294/51 |
| 1,041,416 | A * | 10/1912 | Bilbro | 294/52 |
| 1,962,126 | A * | 6/1934 | Andersen | 403/65 |
| 1,996,071 | A * | 4/1935 | Kahn | 135/20.3 |
| 2,031,442 | A * | 2/1936 | Alphons | 403/93 |
| 2,052,331 | A * | 8/1936 | White | 172/372 |
| 2,419,719 | A * | 4/1947 | Kennedy | 172/372 |
| 2,462,560 | A * | 2/1949 | Schmidt | 135/20.3 |
| 2,833,849 | A * | 5/1958 | Abel | 248/515 |
| 2,863,466 | A * | 12/1958 | Small | 135/20.3 |
| 3,290,816 | A * | 12/1966 | Eklof | 135/20.3 |
| 3,419,295 | A * | 12/1968 | Small | 135/20.1 |
| 3,489,157 | A * | 1/1970 | Pearlstine | 135/20.1 |
| 4,570,901 | A * | 2/1986 | Holtgraver | 251/98 |
| 4,674,522 | A * | 6/1987 | Ma | 135/20.1 |
| 4,688,817 | A * | 8/1987 | Marier | 280/278 |
| 4,877,045 | A * | 10/1989 | Lin | 135/20.1 |
| 5,054,737 | A * | 10/1991 | DeLancey | 24/515 |
| 5,265,969 | A * | 11/1993 | Chuang | 403/94 |
| 5,280,871 | A * | 1/1994 | Chuang | 248/516 |
| 5,518,218 | A * | 5/1996 | Leonard | 248/530 |
| 6,131,971 | A * | 10/2000 | Chen | 294/51 |
| 6,202,659 | B1 * | 3/2001 | Sachs | 135/20.1 |

(Continued)

FOREIGN PATENT DOCUMENTS

| | | | | |
|---|---|---|---|---|
| DE | 2529240 | * | 1/1976 | 135/155 |

(Continued)

*Primary Examiner*—Richard Chilcot
*Assistant Examiner*—Phi Dieu Tran A
(74) *Attorney, Agent, or Firm*—Francis C. Hand; Carella, Byrne, Bain

(57) ABSTRACT

The tilt mechanism has a pair of tubular members and a catch which is fixedly mounted in the upper member and pivotally mounted in the lower member to permit tilting of the two members relative to each other. A pin is mounted in the lower member and is biased into one of several recesses in the lower end of the catch in order to hold the sections in either an upright or a tilted position relative to each other. A coil spring is used to bias the pin into a recess of the catch. Pulling down on the pin allows the tubular members to be tilted relative to each other.

21 Claims, 6 Drawing Sheets

U.S. PATENT DOCUMENTS

| | | | | |
|---|---|---|---|---|
| 6,364,562 | B1 * | 4/2002 | Tung | 403/93 |
| 2002/0066476 | A1 * | 6/2002 | Lin et al. | 135/25.1 |

FOREIGN PATENT DOCUMENTS

| | | | | |
|---|---|---|---|---|
| FR | 773109 | * 11/1934 | | 135/20.1 |
| FR | 2284293 | * 4/1976 | | 135/20.1 |
| GB | 2202141 | * 9/1988 | | 135/20.3 |
| GB | 2266234 | * 10/1993 | | 135/20.1 |

* cited by examiner

FIG. 4
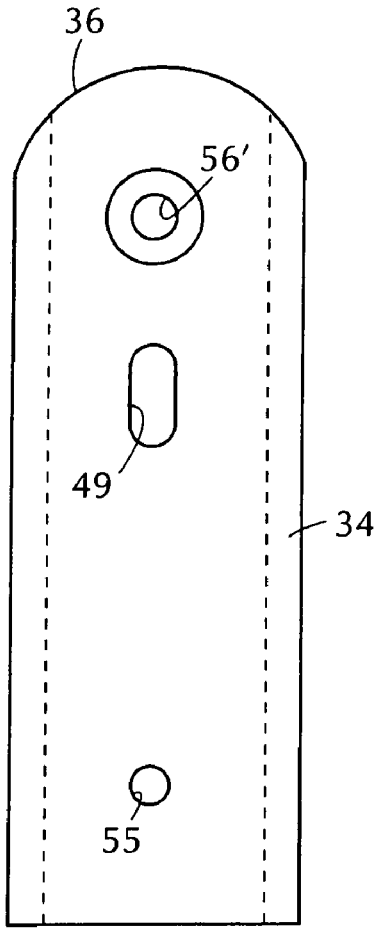
FIG. 6
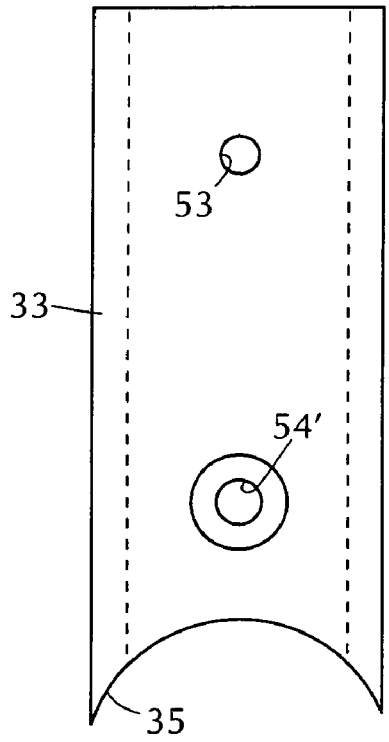
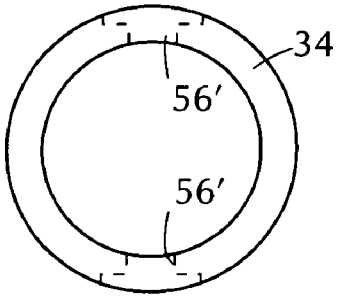
FIG. 5
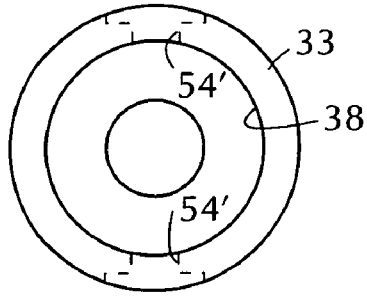
FIG. 7

UMBRELLA TILT MECHANISM

This invention relates to an umbrella tilt mechanism. More particularly, this invention relates to a tilt mechanism for an outdoor umbrella.

As is known, outdoor umbrellas have frequently been provided with mechanisms which permit an upper end of an umbrella pole to tilt relative to a lower end of the umbrella pole. One conventional tilt mechanism includes a bifurcated piece mounted in a fixed lower pole portion and a stem mounted on the lower end of the upper tiltable portion. This stem is pivotally mounted via a pivot pin in the bifurcated piece and a manually operated slide lock is provided to lock the stem in one of three positions relative to the bifurcated piece. Such a tilt mechanism is described and illustrated in U.S. Pat. No. 5,871,024.

It is an object of this invention to provide a tilt mechanism for an umbrella which is of relatively simple robust construction.

It is another object of the invention to provide a tilt mechanism for an outdoor umbrella which can be readily manipulated by a user.

Briefly, the invention provides a tilt mechanism for an umbrella which is comprised of a pair of tubular members that are to be secured to and between two sections of an umbrella pole. In addition, the tilt mechanism includes a catch that is fixedly mounted in one of the members and that projects into the other of the members to receive a locking pin mounted in the other member. The pin and the catch are moveable relative to each other in order to release the pin from the catch to allow the umbrella pole sections to be tilted relative to each other.

The tilt mechanism further comprises a spring means for biasing the pin toward the catch and into one of several recesses in the end face of the catch to lock the tubular members relative to each other.

The pin projects through elongated slots in the tubular member within which the pin is mounted and each end is provided with a rounded head or the like to facilitate manual contact.

Typically, the catch of the tilt mechanism is mounted in the tubular member which is secured to the upper section of an umbrella pole while the pin is mounted in the tubular member which is secured to the lower section of an umbrella pole. In this embodiment, in order to tilt the upper section of the umbrella pole relative to the lower section, the projecting ends of the pin are digitally grasped and pulled downwardly against the force of the spring means. The pin is thus released from the catch so that the upper section of the umbrella pole is free to tilt relative to the lower section. The extent of the tilt is determined by the end of the catch abutting against the inside of the lower tubular member. At this point, the pin is released so that the spring means biases the pin into the recess in the catch which is now aligned with the pin so that the pin locks the catch in place and, thus, the upper umbrella section relative to the lower umbrella section. Subsequent tilting of the upper section of the umbrella into an upright or oppositely tilted position may be carried out in a similar fashion.

The tilt mechanism may be employed with a wood umbrella pole or a metal umbrella pole.

These and other objects and advantages of the invention will become more apparent from the following detailed description taken in conjunction with the accompanying drawings, wherein:

FIG. 4 illustrates a side view of a lower tubular member of the tilt mechanism of FIG. 2;

FIG. 5 illustrates an end view of the tubular member of FIG. 4;

FIG. 6 illustrates a side view of the upper tubular member of the tilt mechanism of FIG. 2;

FIG. 7 illustrates an end view of the tubular member of FIG. 6;

Figure 1:
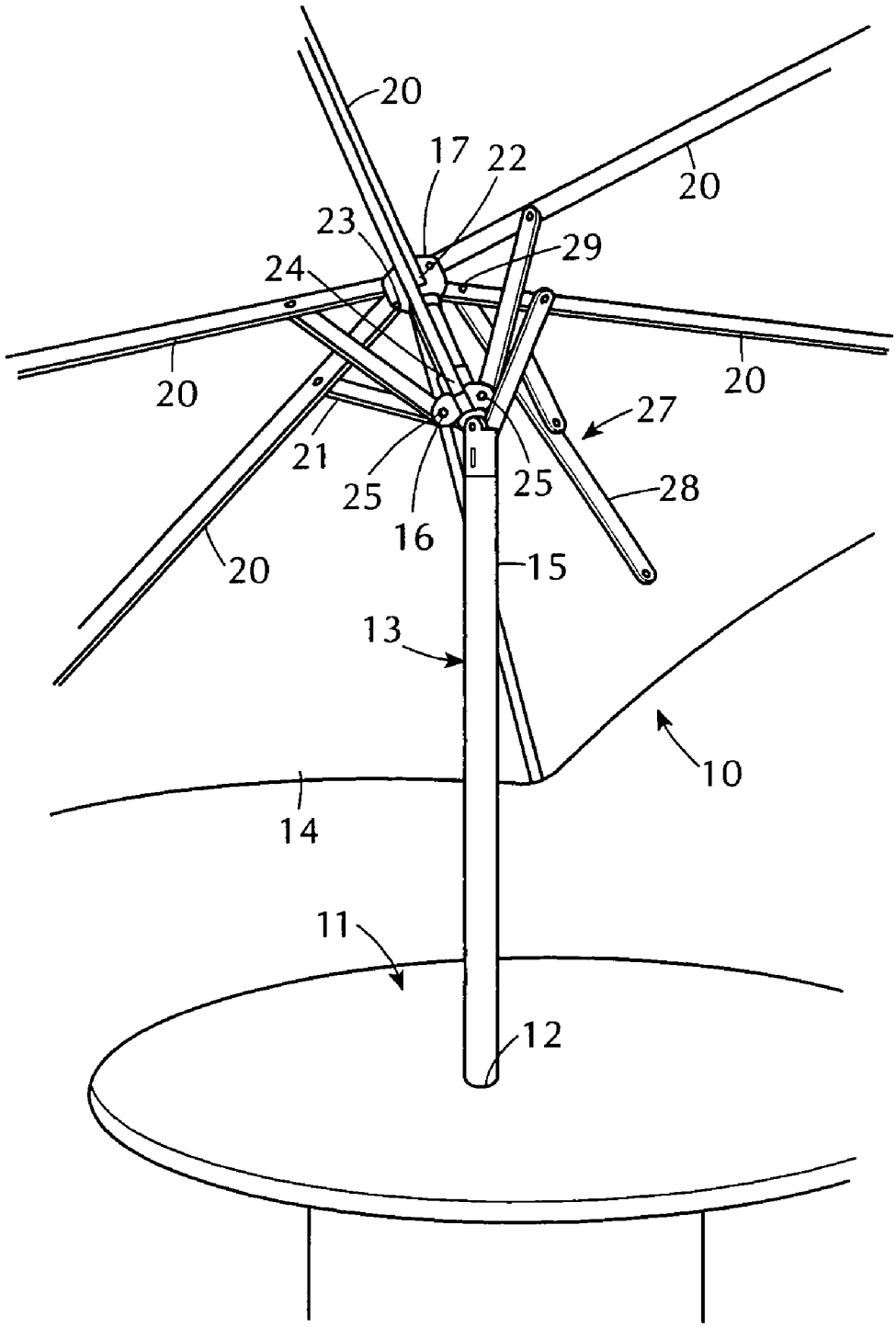
FIG. 1 Prior Art
FIG. 1 illustrates a perspective view of an umbrella with a conventional tilt mechanism in associated with an outdoor table.

Referring to FIG. 1, the umbrella 10 is constructed and sized for use with outdoor furniture, particularly a table 11 having an aperture 12 in a center region to receive the umbrella 10. As indicated, the umbrella 10 is formed of a frame 13 and a cover 14. The frame 13 includes a pole 15, e.g., of solid wood construction, a yoke 16 which is fixedly mounted on the pole 15 and a second yoke 17 which is moveably mounted on the pole 15 above the fixed yoke 16.

A plurality of radially disposed ribs 20 are pivotally connected to the moveable yoke 17 while struts 21 are pivotally connected to the fixed yoke 16 and to the ribs 20. The ribs 20 are provided with slots 22 and pivots 23 for articulation purposes. Likewise, each strut 21 is secured within a slot 24 of the yoke 16 by a screw 25.

A lever means 27 which includes an elongated lever 28 secured by a rivet 29 to one of the ribs 20 is employed for raising and lowering of the ribs 20.

The construction of the umbrella of FIG. 1 is well-known and employs a tilt mechanism of known construction.

Figure 2:
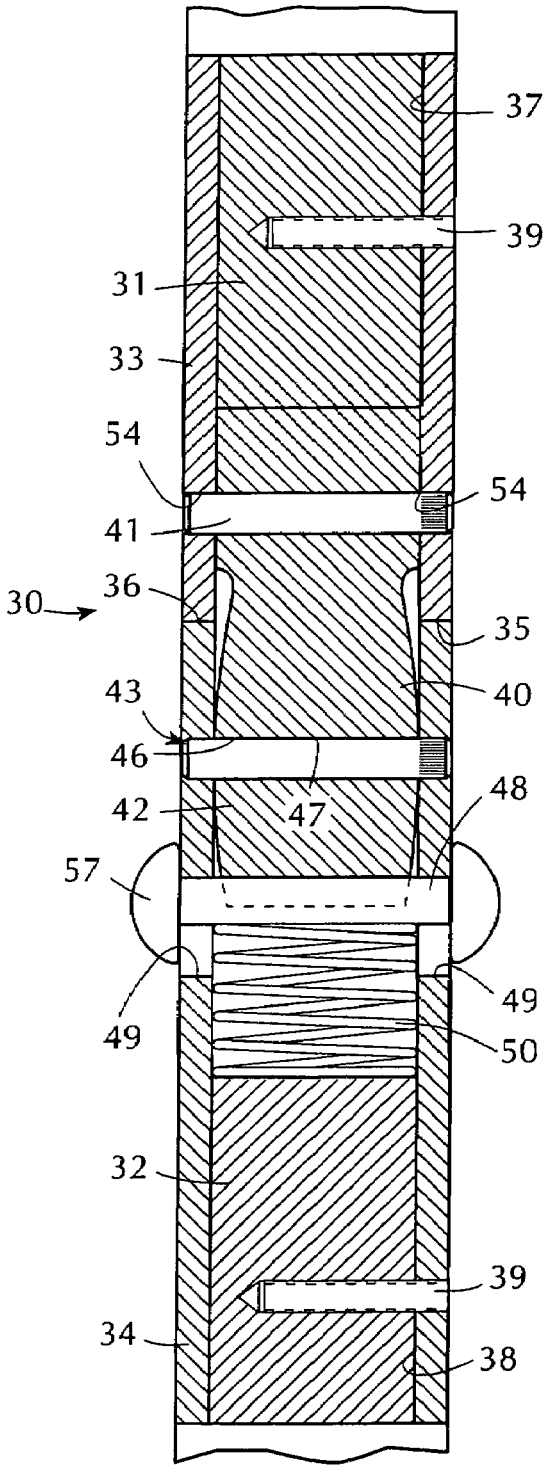
FIG. 2 illustrates a cross-sectional view of a tilt mechanism constructed in accordance with the invention.
Figure 3:
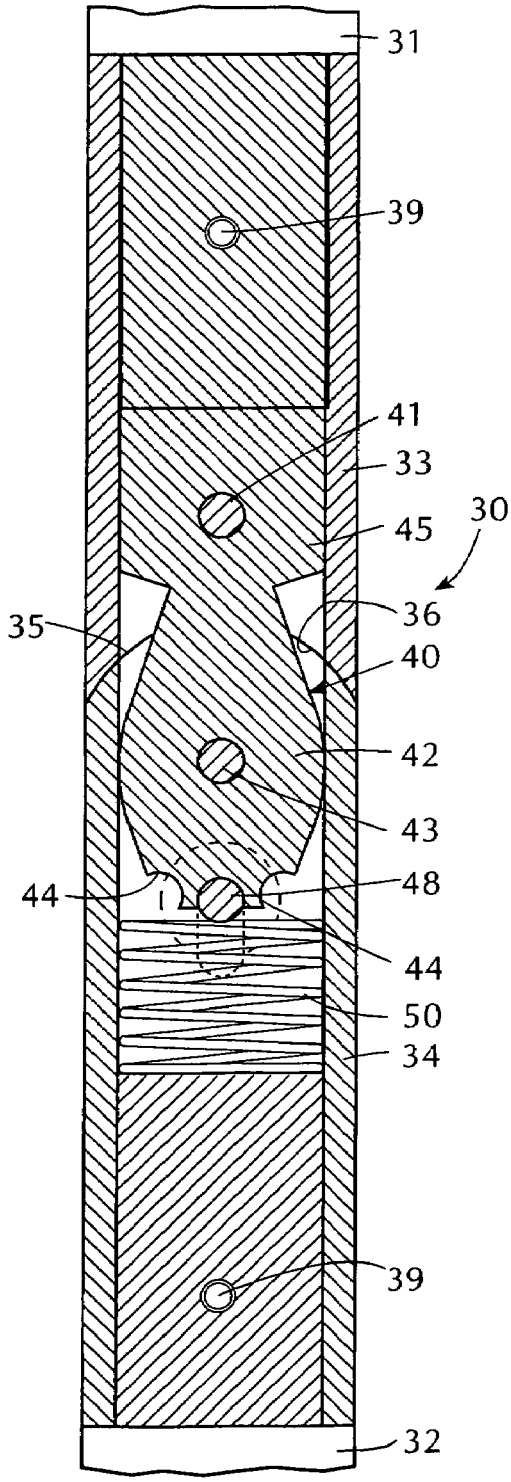
FIG. 3 illustrates a cross-sectional view of the tilt mechanism of FIG. 2 turned 90°.

Referring to FIGS. 2 and 3, the tilt mechanism 30 of the invention is incorporated between an upper section 31 and a lower section 32 of an umbrella pole. The tilt mechanism 30 includes a pair of tubular members 33, 34, which have contoured interfitting end-surfaces 35, 36 to define a smooth, cylindrical contour therebetween when the tubular members 33, 34 are in coaxial alignment with each other as viewed.

The upper tubular member 33 has a cylindrical bore 37 at an upper end to receive the upper wood section 31 of the umbrella pole, while the lower tubular member 34 has a bore 38 at the lower end to receive the lower wood section 32 of the pole. As indicated, a spring pin 39 passes through each respective tubular member 33, 34 into the wood pole section 31,32 in order to secure the tubular members 33,34 in place.

A catch 40 is fixedly mounted along a longitudinal axis in and of the upper tubular member 33 via a rivet or pin 41. In addition, the catch 40 has a stem 42 which projects into the lower tubular member 34 and which is fixed therein by a rivet or pin 43. This rivet or pin 43 allows the members 33, 34 to pivot relative to each other.

Referring to FIG. 3, the stem 42 of the catch 40 has a plurality of recesses 44 at the lower end which projects into the lower tubular member 34. For example, the stem 42 has three recesses 44, one of which is centrally disposed, with the others disposed symmetrically of the centrally disposed recess 44.

Figure 8:
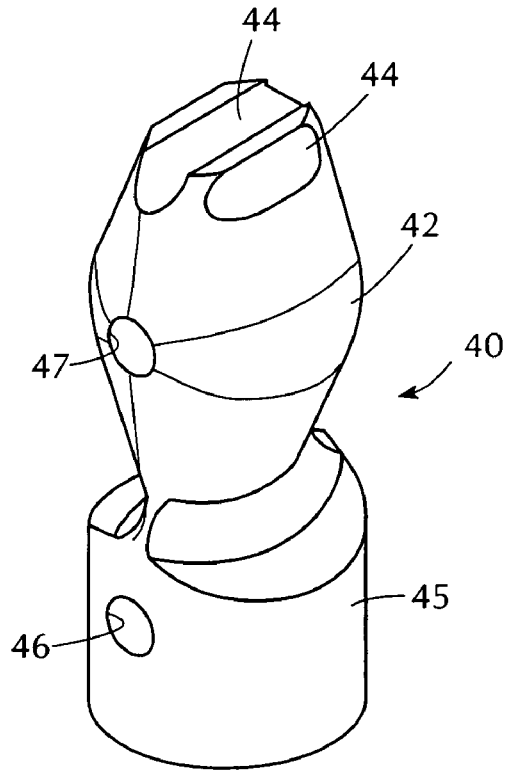
FIG. 8 illustrates a perspective view of a catch employed in the tilt mechanism of FIG. 2.
Figure 9:
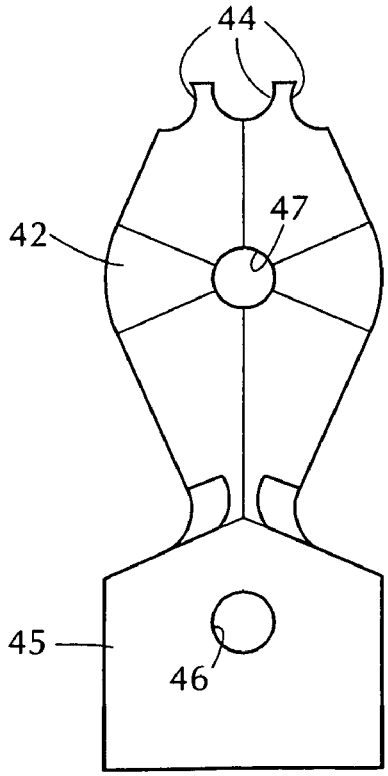
FIG. 9 illustrates a side View of the catch of FIG. 8.

Referring to FIGS. 8 and 9, the catch 40 has a cylindrical base 45 with a through-bore 46 to receive the rivet or pin 41 (see FIGS. 2 and 3). The stem 42 has a reduced portion extending from the base 45 and a reduced upper portion, as viewed. In addition, the stem 42 has a through-bore 47 for passage of the rivet or pin 43 (see FIGS. 2 and 3).

Referring to FIGS. 2 and 3, the tilt mechanism 30 also has a pin 48, which is mounted in the lower tubular member 34 transversely of and in the centrally disposed recess 44 of the catch 40 in order to lock the tubular members 33, 34 relative to each other. The pin 48 has ends which extend through elongated slots 49 in the lower tubular section 34. The pin 48 is thus moveable coaxially relative to the catch 40 along a longitudinal axis of the lower tubular member 34 in order to release the pin 48 from the recess 44 of the catch 40.

A spring means 50 is also disposed within the tubular member 34 for biasing the pin 48 towards the catch 40. As illustrated, the spring means 50 is in the form of a coil spring that abuts the pin 48 and which has an outside diameter slightly smaller than the inside diameter of the tubular member 34. The opposite end of the spring 50 seats on the wood pole section 32.

Referring to FIG. 6, the upper tubular member 33 is provided with a small bore 53 to accommodate the pin 39 (see FIGS. 2 and 3), as well as a pair of diametrically disposed bores 54 (see FIG. 2) to receive a pin 41 or counter-bores 54' (see FIG. 4) to accommodate a rivet 41. As shown, the end surface 35 of the tubular member 33 has a circular radius. As indicated in FIG. 7, the tubular member 33 has a cylindrical bore 38 to receive the wood pole section 31.

Referring to FIGS. 4 and 5, the lower tubular member 34 has a bore 55 to accommodate the pin 39 (see FIGS. 2 and 3) and a pair of diametrically disposed bores 56 (see FIG. 2) to receive a pin 43 or counter-bores 56' (see FIG. 4) to receive a rivet 43. Also, the upper end of the tubular member 34 has a rounded contour on a radius substantially equal to the radius of the surface of the upper tubular member 33.

Referring to FIG. 2, the pin 48 is provided with a rounded head 57 on each end which projects through slots 49 in the tubular member 34 to facilitate manual contact.

When one desires to change the orientation of the upper section 33 of an umbrella relative to the lower section 34, for example, from the aligned position shown in FIGS. 2 and 3, to a tilted position, the exposed heads 57 of the pin 48 are grasped by the thumb and index finger of the user and pushed downwardly. This retracts the pin 48 from within the centrally disposed recess 44 of the catch 40. The upper section of the umbrella may then be manually tilted in one direction or the other until the stem 42 of the catch 40 abuts the inside of the lower section 34 preventing further movement. At this time, the pin 48 is released so that the coil spring 50 biases the pin 48 into the now-aligned offset recess 44 in the stem 42. This locks the tubular sections 33, 34 relative to each other and the upper and lower sections of the umbrella relative to each other.

When one desires to change the tilt position of the umbrella, the rounded heads 57 of the pin 48 are again pulled downwardly to release the pin 48 from the catch 40 so that the umbrella may be brought into an upright position with the tubular members 33,34 coaxially aligned, as indicated in FIGS. 2 and 3.

During tilting of the tubular members 33, 34 relative to each other, the interfitting surfaces of the two members 33, 34 minimize the risk of the fingers of the user being pinched therebetween.

Figure 11:
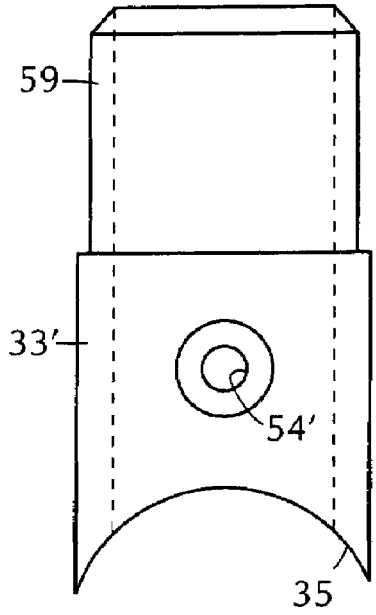
FIG. 11 illustrates an upper tubular section employed with the lower tubular section of FIG. 10.
Figure 10:
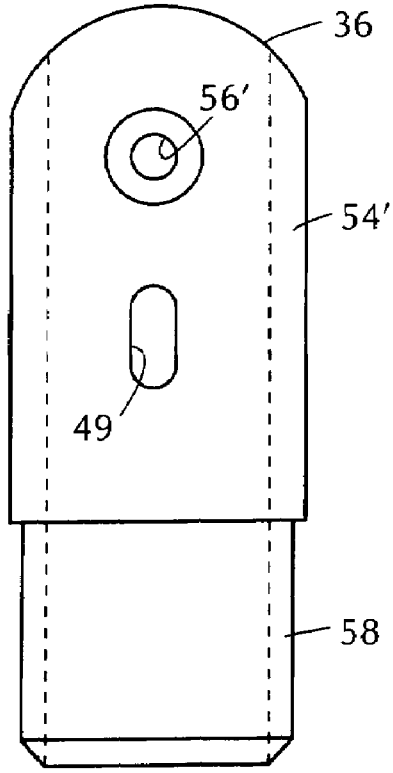
FIG. 10 illustrates the lower tubular section of a modified tilt mechanism in accordance with the invention.
Figure 12:
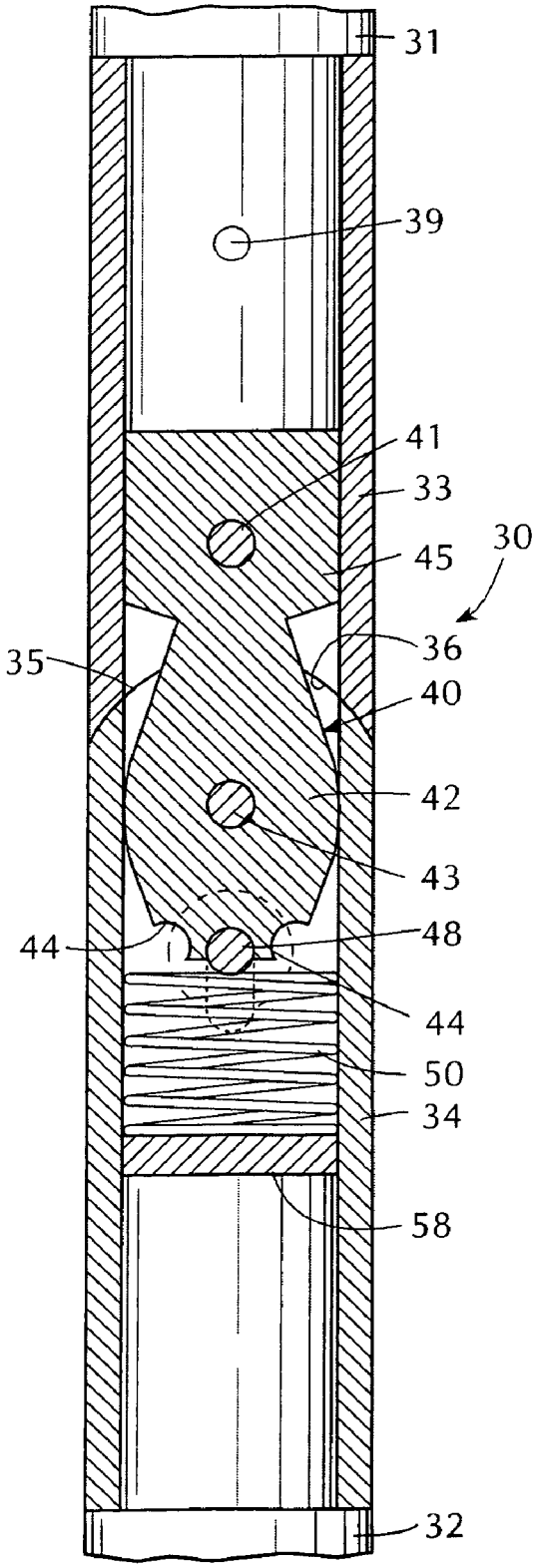
FIG. 12 illustrates a part cross-sectional view of a modified tilt mechanism in accordance with the invention.

Referring to FIG. 10, wherein like reference characters indicate like parts as above, the lower tubular member 34' may be modified for use with a hollow aluminum or other metal umbrella sections. To this end, the lower tubular section 34' has a reduced diameter portion 58 to receive a lower metal section of a pole thereon. Likewise, as shown in FIG. 11, the upper tubular member 33' of the tilt mechanism may be provided with a reduced diameter portion 59 to receive an upper metal section of a pole thereon, for example, in a friction-fit manner.

In addition, the spring means has a plate 58 e.g. in the form of a Bellville washer secured within the lower tubular member 34' in abutment with the bottom of the coil spring (not shown). In this respect, the plate 58 is frictionally secured within and transversely of the tubular member 34'. The degree of the friction fit is such as to resist any tendency of the coil spring to force the plate from the fixed position within the tubular member 34'.

The invention thus provides a tilt mechanism for an outdoor umbrella construction which is of relatively simple construction. Further, the invention provides a tilt mechanism which has substantially smooth interfitting surfaces between tilting sections thereof to avoid pinching a user's fingers or a hand.

The invention further provides a tilt mechanism of robust construction which can be easily manipulated to allow tilting of an upper section of an umbrella relative to a lower section.

What is claimed is:

1. A tilt mechanism for an umbrella comprising;

a first tubular member for securement to a first section of an umbrella pole;

a second tubular member for securement to a second section of an umbrella pole;

a catch mounted in one of said members and projecting into the other of said members, said catch having a plurality of recesses at an end projecting into said other tubular member; and a pin mounted in said other of said tubular members transversely of and in one of said recesses of said catch to lock said tubular members relative to each other, at least one of said pin and said catch being movable coaxially relative to each other to release said pin from a selected one of said recesses.

2. A tilt mechanism as set forth in claim 1 which further comprises spring means in said other tubular member for biasing said pin towards said catch.

3. A tilt mechanism as set forth in claim 2 wherein said spring means includes a coil spring abutting said pin and a plate secured in said other of said tubular members and abutting said coil spring.

4. A tilt mechanism for an umbrella comprising a first tubular member for securement to a first section of an umbrella pole;

a second tubular member for securement to second section of an umbrella pole;

a catch mounted in one of said members and projecting into the other of said members, said catch having a plurality of recesses at an end projecting into said other tubular member; and a pin slidably mounted in said other of said tubular members transversely of and in one of said recesses of said catch to lock said tubular members relative to each other, said pin being movable coaxially away from said catch to allow said other tubular member to tilt relative to said one tubular member.

5. A tilt mechanism as set forth in claim 4 wherein said end of said catch is spaced concentrically from second tubular member with said tubular members in alignment with each other and is in abutment with said second tubular member in a terminal tilted position of said tubular members relative to each other.

6. A tilt mechanism as set forth in claim 5 wherein said tubular members have contoured interfitting end surfaces to define a smooth cylindrical contour therebetween with said tubular members in alignment with each other.

7. A tilt mechanism as set forth in claim 4 wherein said other of said tubular members has a pair of oppositely disposed elongated slots and said pin projects through said slots for grasping thereof.

8. A tilt mechanism for an umbrella comprising a first tubular member for securement to a first section of an umbrella pole;

a second tubular member for securement to a second section of an umbrella pole;

a catch fixedly mounted in one of said members along a longitudinal axis and having a stem projecting into and pivotally secured to the other of said members to allow said members to pivot relative to each other, said stem having a plurality of recesses at an end thereof; and a pin mounted in said other of said tubular members transversely of a longitudinal axis of said other of said tubular members and in one of said recesses of said catch to lock said tubular members relative to each other, at least one of said pin and said catch being movable coaxially relative to each other to release said pin from a selected one of said recesses.

9. A tilt mechanism as set forth in claim 8 which further comprises spring means in said other tubular member for biasing said pin towards said catch.

10. A tilt mechanism as set forth in claim 9 wherein said spring means includes a coil spring abutting said pin and a plate secured in said other of said tubular members and abutting said coil spring.

11. A tilt mechanism as set forth in claim 8 wherein said pin is slidably mounted in said other of said tubular members to move away from said catch to allow said other tubular member to tilt relative to said one tubular member.

12. A tilt mechanism as set forth in claim 11 wherein said pin has a rounded head at each end projecting from said other tubular member for manual contact thereof.

13. A tilt mechanism for an umbrella comprising a first tubular member for securement to an upper section of an umbrella pole;

a second tubular member for securement to a lower section of an umbrella pole;

a catch fixedly mounted in said first member along a longitudinal axis and having a stem projecting into said second member, said stem having a plurality of recesses at a lower end thereof;

a rivet pivotally securing said stem in said second member to allow said members to pivot relative to each other;

a pin mounted in said second member transversely of a longitudinal axis of said second tubular member and in one of said recesses of said catch to lock said tubular members relative to each other; and spring means coaxially mounted in said second tubular member for biasing said pin towards said catch and into a selected one of said recesses.

14. A tilt mechanism as set forth in claim 13 wherein said spring means includes a coil spring abutting said pin and a plate secured in said second member and abutting said coil spring.

15. A tilt mechanism as set forth in claim 14 wherein said plate is frictionally secured within and transversely of said second member.

16. A tilt mechanism as set forth in claim 13 wherein one of said recesses is disposed centrally of said stem and a pair of recesses is disposed to opposite sides of said centrally disposed recess.

17. A tilt mechanism as set forth in claim 13 wherein said first member has a bore at an upper end to receive an upper wood section of a pole therein and said second member has a bore at a lower end to receive a lower wood section of a pole therein.

18. A tilt mechanism as set forth in claim 13 wherein said first member has a reduced diameter portion at an upper end to receive an upper metal section of a pole thereon and said second member has a reduced diameter portion at a lower end to receive a lower metal section of a pole thereon.

19. A tilt mechanism as set forth in claim 13 wherein said stem is spaced concentrically from second tubular member with said tubular members in alignment with each other and is in abutment with said second tubular member in a terminal tilted position of said tubular members relative to each other.

20. A tilt mechanism as set forth in claim 19 wherein said tubular members have contoured interfitting end surfaces to define a smooth cylindrical contour therebetween with said tubular members in alignment with each other.

21. A tilt mechanism as set forth in claim 13 wherein said second tubular member has a pair of oppositely disposed elongated slots and said pin projects through said slots for grasping thereof.

* * * * *